United States Patent [19]

Laepple et al.

[11] 4,303,537

[45] Dec. 1, 1981

[54] WATER BASED LUBRICANT

[75] Inventors: Werner Laepple, Karlsfeld; Gisela Wienert, Munich, both of Fed. Rep. of Germany

[73] Assignee: Dow Corning GmbH, Munich, Fed. Rep. of Germany

[21] Appl. No.: 83,041

[22] Filed: Oct. 9, 1979

[30] Foreign Application Priority Data

Nov. 15, 1978 [DE] Fed. Rep. of Germany ..... 2849617

[51] Int. Cl.[3] ..... C10M 3/18

[52] U.S. Cl. ..... 252/30; 252/49.5; 72/42

[58] Field of Search ..... 252/30, 49.5, 28, 29; 72/42

[56] References Cited

U.S. PATENT DOCUMENTS

| | | | |
|---|---|---|---|
| 3,051,586 | 8/1962 | Heath | 252/30 |
| 3,843,529 | 10/1974 | Bertrand | 252/28 |
| 4,052,323 | 10/1977 | Feneberger et al. | 252/49.5 |
| 4,094,799 | 6/1978 | DeVries et al. | 252/29 |

*Primary Examiner*—Jacqueline V. Howard

*Attorney, Agent, or Firm*—Robert F. Fleming, Jr.

[57] ABSTRACT

A stable aqueous dispersion of a solid lubricant combination of $MoS_2$ and graphite and an acrylic resin is used to coat bearing members to provide an air drying long lasting lubricant coating. A typical formulation is 60 to 80% water, 15 to 30% $MoS_2$ and graphite in the weight ratio of 1.5:1 to 2.5:1 and 5 to 10% polybutyl acrylate. The $MoS_2$ and graphite preferably have a particle size of less than 5 $\mu$m.

5 Claims, No Drawings

WATER BASED LUBRICANT

BACKGROUND OF THE INVENTION

From U.S. Pat. No. 3,079,204, bearing structures are already known which are provided with a dry lubricant film. The film, as solid lubricant substance, contains molybdenum disulfide, with or without additional graphite, and contains, as binding agent, a dried water-soluble metal silicate. The lubricant film is preferably composed of at least 50 to not more than 87% molybdenum disulfide, b 0–7.7% graphite, and 50–13% dried, water-soluble metal silicate. The lubricant film is applied from an aqueous suspension of the individual solid components; this suspension contains enough water to dissolve the water-soluble metal silicate, so that, with the solid lubricant substance, it can form a workable, uniform mixture. Such aqueous compositions indeed produce usable lubricant films, but they are unstable and lead to aggregates, and in this way the viscosity of such dispersions is increased, and, moreover, in a fashion which is uncontrollable. The use of such aqueous compositions is accordingly limited to those applications in which a dry lubricant film is immediately formed, and thus these compositions have no significance as directly usable liquid aqueous lubricants.

In U.S. Pat. No. 4,088,585, a composition is described which is suitable for the formation of dry lubricant films on metal workpieces; the composition consists of powdered molybdenum disulfide, soluble silicate from silicon dioxide, sodium oxide and/or potassium oxide, hydroxyethylcellulose, and water as the remainder. The quantity of powdered molybdenum disulfide in general is about 5–30%, preferably about 10–30%. The soluble silicate is in general present in a quantity of 0.6–12%, and here the weight ratio of silicon dioxide to sodium and/or potassium oxide is more than about 1.5 and less than about 4. The content of hydroxyethylcellulose is in general between 0.2 and 3%. The lubricant composition can, along with the indicated essential components, also contain small quantities of a biocide and an antifoam additive.

The aforementioned aqueous lubricants indeed supply an adequate lubrication to workpieces, but they have the disadvantage that, like all lubricants containing silicate, they do not adhere adequately to the part to be lubricated, so that the lubricant effect which can be achieved with them is only of limited duration.

From German Patent Application No. 1,815,829, stable aqueous lubricants are known which are suitable for the formation of dry liquid films, and these lubricants consist of 1. an aqueous solution of an alkali metal silicate and an alkali metal lignosulfonate, as dispersing phase,
2. a finely divided dry-film lubricant as disperse phase and, on occasion
3. a wetting agent.

The dry-film lubricant is preferably molybdenum disulfide and/or graphite with an average particle size of less than about 1μ. The aqueous dispersing agent phase in general contains about 30–40 parts by weight water, about 30–40 parts by weight alkali metal silicate (preferably sodium or potassium silicate) and 0.25–5 parts by weight alkali metal lignosulfonate, such as potassium or sodium lignosulfonate, in general, about 25–35 parts by weight dry solid lubricant are dispersed in this phase. On occasion, wetting agents can also be present. A preferred composition contains about 35 parts by weight water, about 35 parts by weight alkali metal silicate, about 30 parts by weight dry-film lubricant, about 0.5 parts alkali metal lignosulfonate, and about 0.1 parts wetting agent.

In comparison to the aqueous lubricants already described, the lubricant above indeed has the advantage of adequate stability, while at the same time, like all lubricants containing silicates, there is a significant disadvantage: the lubricant film obtained in the manner described does not adhere adequately to the given carrier. The attainable lubricant effect is thus only of limited duration.

The invention now has the task of creating a new aqueous lubricant which, with a lubricant effect which is comparable to, or even better than, the known aqueous lubricants, results in a significantly longer duration for the lubricant effect. The aqueous lubricant to be created should be compatible with the environment and should not have an unpleasant odor, i.e., it should not contain organic solvents or substances with annoying odors, it should be easy to apply in a manner suitable for industrial mass production, and it should dry rapidly.

SUMMARY OF THE INVENTION

These tasks are accomplished by the aqueous lubricant according to the invention mentioned at the outset, as follows: this lubricant contains, as binding agent (c), a hard acrylic resin which dries in air.

DETAILED DESCRIPTION OF THE INVENTION

The aqueous lubricant according to the invention preferably contains (a) about 60–80 wt %, especially 65–75 wt % water;
(b) about 15–30 wt %, particularly about 18–25 wt %, of a solid lubricant combination of molybdenum disulfide and graphite, in a weight ratio of about 1.5–2.5:1,
(c) about 5–10 wt %, particularly about 6–8 wt %, acrylic resin as binding agent, and here the components (a), (b) and (c) combine to 100 wt %;
(d) about 0.1–2 wt %, particularly about 0.4–0.8 wt %, of a dispersing and/or wetting agent, relative to the total quantity of the components (a), (b) and (c); and
(e) on occasion, about 0.1–1 wt %, especially about 0.3–0.7 wt %, of the additional auxiliary substances, relative to the total quantity of the components (a), (b) and (c).

An especially preferred aqueous lubricant contains molybdenum disulfide and graphite in a weight ratio of about 2:1.

As additional auxiliary substances (e) which may be present, the aqueous lubricant according to the invention can chiefly contain the following substances:

(e 1) a thickening agent,
(e 2) a rust inhibitor,
(e 3) a preservative and/or
(e 4) an antifoaming additive.

The grain size of the molybdenum disulfide present in the aqueous lubricant according to the invention has a certain significance. The aqueous lubricant should preferably have a pH value of 9 to 10, and this value is influenced, among other things, by the particle size of the molybdenum disulfide used. Thus, for example, microfine molybdenum disulfide produces a pH value which is too low, and from this an aqueous lubricant results which has a storage stability which is too low and at the same time exhibits increased corrosion. The molydenum disulfide contained in the present aqueous lubricant accordingly should preferably have an average particle size (sedimentation analysis according to Adreasen) of less than 5μ, and particularly an average particle size of1–4μ. The molybdenum disulfide distributed under the name Molyform 40 ("fine") and described in the prospectus of Hermann C. Starck, D-1000 Berlin, with the Code Nos. 671-26 and 671-211, has proved to be especially suitable.

The particle size of the graphite contained in the aqueous lubricant has also proved to have a certain influence on the lubricant behavior of the aqueous lubricant. The graphite contained in the lubricant accordingly should preferably have a particle size (according to the Fisher Sub Sieve Sizer) of less than 5μ, and here most of the graphite used should have a particle size of less than 2μ. The graphite distributed under the name Kropfmühl Pudergraphit Ultrafeinmahlung 2 [Kropfmühl Powdered Graphite Ultrafine Grind 2] (UV 2-99.5/99.9) by the Graphitwerk Kropfmühl AG, D-8000 Munich has proved to be especially suitable.

For the acrylic resin present as binding agent (c) in the aqueous lubricant according to the invention, we in general use a so-called pure acrylic resin. Such an acrylic resin can be a polymer or copolymer of acrylic acid, methacrylic acid or $C_1$–$C_4$ alkyl esters of these. A polymer essentially of butyl acrylate is especially preferred as acrylic resin.

The acrylic resins contained in the aqueous lubricant according to the invention are optimally used in the form of acrylic resin dispersions in water, since these forms already make possible a uniform and stable distribution of the given acrylic resin in such an aqueous lubricant. Pure acrylic resin dispersions distributed by the company Röhm GmbH, D-6100 Darmstadt, under the tradename Plextol have, among others, proven to be suitable for the invention, and of these, the product with the name Plextol D 540, has proven to be especially suitable; this product is an aqueous dispersion of a pure acrylic resin on the basis of a polymer essentially of acrylic acid butyl esters. Such products are described, for example in the company prospectus of Rohm GmbH, Darmstadt, with the Code Nos. 30/274/2947 and 40/176/3952.

The quantity of water present in the aqueous acrylic resin dispersions obviously must be taken into account in the formulation of aqueous lubricants according to the invention; the weight percent indicated above for the water quantity (with reference to the weight percentage composition of preferred aqueous lubricants according to the invention) accordingly includes the water already present in the corresponding aqueous acrylic resin dispersion.

The dispersing and/or wetting agents present in such aqueous acrylic resin dispersions can wholly or partially replace dispersing and/or wetting agents present in the aqueous lubricants as component (d). This means that with the use of suitable aqueous acrylic resin dispersions, on occasion, we may forego separate addition of component (d).

In principle, as component (d), any conventional dispersing and/or wetting agent can be used which adequately disperses and/or wets the components present in the aqueous lubricant according to the invention. As dispersing and/or wetting agent (d), an ammonium salt of a low-molecular polyacrylic acid has proved to be especially suitable; such a salt is sold, for example, by Hoechst AG, D-63230 Frankfurt, under the name Dispergiermittel PA 30, and described in the company prospectus with Code No. G 1018 (1.75).

In principle, in the aqueous lubricant according to the invention, all customary thickening agents can be used. However, for this purpose, the preferred thickening agents are those which have good solubility in water and are not pH-dependent, and which result in a time-delay in the thickening effect, so that the complete thickening effect is first achieved after complete preparation of the aqueous lubricant, for example, after a stirring time of about 1 hour. Such a thickening agent makes possible simple manufacturing of the aqueous lubricant, requiring only brief expenditure of labor. As thickening agent for the present purpose, all known, conveniently water-soluble organic, natural or synthetic thickening agents are suitable, and especially thickening agents on the basis of polysaccharides. Such a thickening is distributed by the company G. M. Langer & Co., D-2863 Ritterhude, under the tradename Kelzan, and described in more detail in the pamphlet I/530 of this company. The use of about 0.3 wt % kelzan results in an aqueous lubricant with a processing viscosity of about 220 cP, and this can be stored without problems for more than 12 months.

The aqueous lubricant according to the invention, as additional components, preferably also contains a rust inhibitor (and here, in principle, any material known to be suitable for this purpose can be used). Appropriate water-soluble complex compounds with a predominating proportion of organic nitrite and semiorganic mineral salts of various amine compounds have proved to be especially favorable, and such a material can, for example, be obtained from C. H. Erbsloh Co., D-4000 Dusseldorf, under the tradename Korrosioninhibitor 562. This product is completely soluble in water and, in the form of a 10% aqueous solution produces a pH value of about 8.5. The content of nitrite ions in the product amounts to about 17%, while the total content of active substances is about 70–80%. The amine compounds present in the product are chiefly long-chain amines which are predominantly present in the form of mineral salts.

A customary preservative can also be present in the aqueous lubricant according to the invention, as another possible component. For this purpose, in principle, all conventional preservatives are suitable. A product on the basis of 1-(3-chloroally)-3,5,7-triaza-1-azonia-adamantane chloride has proved to be especially suitable for this compound can be obtained from Dow Chemical Europe SA, CH-8810 Horgen, under the name Dowicil 75, and is described, for example, in the prospectus of the Dow company with the name Dowicil 75, preservative auxiliary.

Finally, the aqueous lubricant according to the invention can contain any conventional antifoam additive for the purpose of avoiding an excess development of foam when the lubricant is used, and here a liquid triglyceride polyoxyethylene condensate has proved to be especially suitable for this purpose. Such a product is distributed, for example, by G. M. Langer & Co., D-2863 Ritterhude, under the name Glocem D 20 and is described in further detail in the pamphlet I/304 of this company.

The aqueous lubricant according to the invention can obviously also be present in a highly concentrated form; for example, in the form of a condensate with a total water content of only about 35–45 wt %. This produces simplifications in storage and in the shipping of such lubricants, and here the corresponding condensate can, directly at the point of application, be brought to the working concentration required or desired for usage by dilution with water.

The aqueous lubricant according to the invention can be applied in the customary fashion by spraying, immersion or spreading on a metal surface which is to be provided with a lubricant lacquer and which, conveniently, has been previously appropriately degreased. Here, after a simple drying in air, within a short time, a dry lubricant film results which is especially suitable for a working-life lubrication of machine parts which come under high pressures. The lubricant properties of the present aqueous lubricant can be improved, moreover, by a conventional surface pretreatment of the metal surfaces which are to be treated with such an aqueous lubricant (for example, by phosphatizing, sandblasting or anodizing of such metal surfaces).

The especially good properties of the present aqueous lubricant are attributable to the use, according to the invention, of an air-drying* hard acrylic resin and thus of a specific organic binding agent, while according to the prior art, hitherto, as a rule, inorganic binding agents have been used for this purpose, that is chiefly water-soluble metal silicates; this appears, for example, in U.S. Pat. No. 3,079,204. A lubricant developed on the basis of this U.S. Patent, for example, is commercially available under the name Molykote X-15 and this lubricant, like the lubricant according to the invention, contains a solid lubricant combination of a finely-divided molybdenum disulfide and finely divided graphite; but here these two constituents are in a weight ratio to one another of 10:1. Appropriate comparison tests between an aqueous lubricant according to the invention and the lubricant Molykote X-15 show that the former is far superior to the latter in lubricant behavior and in other properties which are to be required of such an agent.

* The term air-drying means the resin has a minimum film-forming (MTF) of room temperature, i.e. about 21° C.

The following examples are illustrative only and the proper scope of the invention is set forth in the claims.

EXAMPLE 1

To produce a formulation amounting to a total of 3000 g of an aqueous lubricant according to the invention, we mix, in a porcelain mill (capacity 5 kg) half filled with porcelain pellets of all sizes, 195 g (6.5 wt %) finely divided graphite (UF 2-99.5/99.9), 390 g (13.0 wt %) finely divided molybdenum disulfide (Molyform 40 ("fine"), 1,800 g (60 wt %) distilled water, 15 g (0.5 wt %) dispersing and/or wetting agent on the basis of an ammonium salt of a low-molecular polyacrylic acid (Dispergiermittel PA 30), and 9.9 g (0.3 wt %) thickening agent on the basis of a polysaccharide (Kelzan); the entirety is mixed together slightly and then ground for about 20 hours in the porcelain mill. Then the contents of the porcelain mill are put into a previously weighed plastic container of 5 kg capacity, here the substance abraded from the porcelain pellets is screened away. Then the container is weighed, together with its contents, to determine the total yield of aqueous lubricant. Any material loss (water loss) which may occur during the milling process is made up by addition of corresponding quantity of water until the target weight of 2,409 g is attained.

Then 156 g (5.2 wt %) distilled water are stirred together with 15 g (0.5 wt %) of a preservative on the basis of 1-(3-chloroallyl)-3,5,7-1-azonia-adamantane chloride (Dowicil 75) until there is a complete dissolution of the preservative; the concentrate thus obtained is added, with careful and adequate stirring, to the product obtained from the porcelain mill. With additional stirring (over a screen to filter away any hardened portions of binding agent) the entirety is mixed with 405 g (13.5 wt %) of a water dispersion containing 50% by weight of an acrylic resin serving as a binding agent, which is a polymer of essentially butyl acrylate* (Plextol D 540), and stirring of the entirety is continued. The formulation thus obtained, after thorough mixing, with additional stirring, is then mixed together with 15 g (0.5 wt %) rust inhibitor on the basis of a conveniently water-soluble complex compound with a predominating proportion of organic nitrite and semiorganic mineral salts of various amine compounds (Rostinhibitor 562) and with 1.0 wt % liquid triglyceride polyoxyethylene condensate as antifoam additive (Glocem D 20), and the aqueous lubricant thus obtained is allowed to stand for one more day. The aqeuous lubricant formed in this fashion has a total water proportion of 71.95 wt % and accordingly a total solid proportion of 28.05 wt %. It is ready for direct use in this form.

* The polybutylacrylate has the following film properties each determined by test DIN 53445: Minimum Film Forming Temperature about 21° C., Tensile Strength (Pull rate of 100 mm/min.) 12.5 N/mm$^2$, Elongation at Break (Pull rate of 100 mm/min.) 250% Shear Modulus G 20$^b$C—600N/mm$^2$.

EXAMPLE 2

To compare the lubricant behavior and other physical properties, the aqueous lubricant obtained according to Example 1 and the well-known lubricant Molykote X-15 are subjected to comparative studies. The results thus obtained appear in the table.

The data from the table show that the aqueous lubricant according to the invention is far superior to the known lubricant in many respects, and here especially we should mention the values in the LWF-1 machine which are 6 times higher, and the fact that the working life is increased by ⅓.

TABLE

| | Molykote X-15 | Lubricant According to Example 1 |
|---|---|---|
| LFW-1 machine (revolutions) | 50.000 | 300.000 |
| Particle size (μm) | 60–80 | on the average 15 |
| FALEX testing machine: | | |
| material load (kg/cm$^2$) | 2.250 | 2.250 |
| working life (minutes) | 19 | 27 |
| Drying: | | |
| temperature (°C.) | room temperature | room temperature |
| time (minutes) | 60 | 15 |
| ready for use (minutes) | 60 | 40 |
| storage stability (months) | 6 | 12 |

That which is claimed is:

1. A stable aqueous lubricant composition which contains (a) about 60 to 80 percent by weight water, (b) 15 to 30 percent by weight of a combination of molybdenum disulfide, having a particle size in the range of 1 to 5 inclusive and graphite in the weight ratio of 1.5:1 to 2.5:1, (c) 5 to 10 percent of a binder which is a hard, air drying polymer of an alkyl ester of methacrylic or acrylic acid in which the alkyl group contains 1 to 4 carbon atoms, (a), (b) and (c) combined giving 100 percent by weight, (d) about 0.1 to 2 percent by weight of a dispersing and/or wetting agent, and (e) about 0.1 to 1 percent by weight of a water soluble thickening agent, the weights of (d) and (e) both being based on the total weight of (a), (b) and (c).

2. A composition of claim 1 in which (c) is polybutylacrylate, (d) is the ammonium salt of a low molecular weight polyacrylic acid and (e) is a polysaccharide.

3. The composition of claim 1 in which the molybdenum disulfide and graphite are in the weight ratio of 2:1.

4. The composition of claim 3 in which (c) is polybutylacrylate, (d) is the ammonium salt of a low molecular weight polyacrylic acid and (e) is a polysaccharide.

5. The composition of claims 1, 2, 3 or 4 in which the water is present in amount of 35 to 45 percent by weight based on the total weight of the composition.

* * * * *

UNITED STATES PATENT AND TRADEMARK OFFICE

CERTIFICATE OF CORRECTION

PATENT NO. : 4,303,537

DATED : December 1, 1981

INVENTOR(S) : Werner Laepple and Giesela Wienert

It is certified that error appears in the above—identified patent and that said Letters Patent is hereby corrected as shown below:

In Column 1, line 12; the line reading "num disulfide, b 0-7.7% graphite, and 50-13% dried," should read "num disulfide, 0-7.7% graphite, and 50-13% dried,"

In Column 3, line 6; the line reading "particle size ofl-4μ. The molybdenum disulfide distrib-" should read "particle size of 1-4μ. The molybdenum disulfide distrib-"

UNITED STATES PATENT AND TRADEMARK OFFICE

CERTIFICATE OF CORRECTION

PATENT NO. : 4,303,537

DATED : December 1, 1981

INVENTOR(S) : Werner Laepple and Giesela Wienert

It is certified that error appears in the above—identified patent and that said Letters Patent is hereby corrected as shown below:

In Column 5, line 49; the line reading "("fine"), 1,800 g (60 wt %) distilled water, 15 g (0.5 wt" should read "("fine")), 1,800 g (60 wt %) distilled water, 15 g (0.5 wt"

In Column 6 the Claims, line 62; the line reading "range of 1 to 5 inclusive and graphite in the weight" should read "range of 1 to 5μ inclusive and graphite in the weight"

In Column 7 the Claims, line 1; the line reading "(d) about 0.1 to 2 percent by weight of a dispersing" should read "(d) about .1 to 2 percent by weight of a dispersing"

Signed and Sealed this

*Twenty-fourth* Day of *January 1984*

[SEAL]

*Attest:*

GERALD J. MOSSINGHOFF

*Attesting Officer*

*Commissioner of Patents and Trademarks*